US005146973A

United States Patent [19]

Chandley

[11] Patent Number: 5,146,973

[45] Date of Patent: Sep. 15, 1992

[54] COUNTERGRAVITY CASTING METHOD AND APPARATUS

[75] Inventor: George D. Chandley, Amherst, N.H.

[73] Assignee: Hitchiner Manufacturing Co., Inc., Milford, N.H.

[21] Appl. No.: 628,479

[22] Filed: Dec. 17, 1990

Related U.S. Application Data

[63] Continuation-in-part of Ser. No. 303,813, Jan. 27, 1989, Pat. No. 4,982,777.

[51] Int. Cl.[5] ..... B22D 18/06

[52] U.S. Cl. ..... 164/63; 164/255

[58] Field of Search ..... 164/63, 65, 119, 254, 164/255, 256, 306, 133, 134

[56] References Cited

U.S. PATENT DOCUMENTS 1,100,831 6/1914 Kline ..... 164/134

FOREIGN PATENT DOCUMENTS 1296294 3/1987 U.S.S.R. ..... 164/134

*Primary Examiner*—Kuang Y. Lin

*Attorney, Agent, or Firm*—Edward J. Timmer

[57] ABSTRACT

Method and apparatus for the differential pressure, countergravity casting of molten metal in shortened cycle times into a casting mold having an inlet passage-forming collar that provides a dam to reduce runout of the melt from the mold during tilting of the mold from the casting position to an inverted solidification position.

13 Claims, 5 Drawing Sheets

COUNTERGRAVITY CASTING METHOD AND APPARATUS

This application is a continuation-in-part of patent application Ser. No. 303,813 filed Jan. 27, 1989, now U.S. Pat. No. 4,982,777.

FIELD OF THE INVENTION

The present invention relates to the countergravity casting of molten metal in a gas permeable casting mold and, in particular, to the countergravity casting of molten metal in shortened cycle times by reducing the time that a differential pressure must be applied to the casting mold after it is filled with molten metal and during solidification of the molten metal in the casting mold.

BACKGROUND OF THE INVENTION

The Chandley U.S. Pat. No. 4,112,997 issued Sep. 12, 1978, illustrates the countergravity casting of molten metal in a gas permeable shell mold wherein the lower end of a riser passage is submerged in a molten metal pool, a reduced pressure is applied to a plurality of mold cavities through the gas permeable walls of the mold to urge molten metal to flow upwardly through a stabilizing and filtering screen in each ingate to each mold cavity to fill each mold cavity with molten metal. After the mold cavities are filled with molten metal and most of the casting has solidified, the mold is removed from the molten metal pool with the reduced pressure maintained on the mold cavities. Upon removal of the mold from the molten metal pool, the molten metal in the riser passage and in the portion of the ingates between the stabilizing and filtering screen and the riser passage drains from the mold by gravity-induced run-out before the molten metal in the mold cavities is completely solidified. The molten metal in the mold cavities and in the portion of the ingates between the stabilizing and filtering screen and the mold cavity is held against run-out by the reduced pressure applied on the mold cavities and by the stabilizing effect of the stabilizing and filtering screens on the molten metal. After at least a solidified skin of metal is formed in the mold cavity and in the portion of the ingates between the screen and the mold cavity, the reduced pressure applied to the mold is released. However, as a result of the small dimension of the stabilizing and filtering screen in the direction of molten metal flow, the reduced pressure must be applied to the mold cavities for a relatively long time, e.g., 200 seconds, until the solidified skin forms in the mold cavity and in the portion of the ingates between the screen and the mold cavity. This prolongs the casting cycle time, and reduces the rate of production of solidified castings. Moreover, stabilizing and filtering screens suitable for use in the casting of high melting point metals (e.g., metals having melting temperatures above about 2950° F.) are expensive and increase the cost of the castings so produced.

The Chandley et al U.S. Pat. No. 4,589,466 issued May 20, 1986, illustrates the countergravity casting of molten metal wherein a gas permeable mold includes a crimpable fill pipe sealingly connected to the lower end of the riser passage and adapted for immersion in an underlying molten metal pool during casting to fill a plurality of mold cavities in the mold. Once the mold cavities are filled with molten metal by countergravity casting from the underlying casting melt, the fill pipe is crimped closed while immersed in the molten metal pool to prevent molten metal run-out upon subsequent removal of the fill pipe from the molten metal pool. Molten metal remains and solidifies in the fill pipe above the crimped portion and in the mold cavities, the intermediate riser passage and the ingates to each mold cavity. In the casting of higher melting point metals the use of a crimpable fill pipe provides an unsatisfactory degree of reliability since the hot metal can occasionally melt through the fill pipe even when it is coated with a ceramic wash or layer. Moreover, the crimped fill pipe is not reusable.

The Sylvester U.S. Pat. No. 3,032,841 issued May 8, 1982, illustrates in one embodiment an ingate structure through which molten metal is supplied in countergravity fashion to fill a plurality of gas impermeable molds. A stopper valve is disposed in the ingate structure between a depending fill tube and the mold cavities and is movable in the ingate structure to a closed position after the mold cavities are filled to prevent molten metal run-out. After the stopper is moved to the closed portion, the molten metal in the ingate passages above the valve is allowed to at least partially solidify to substantially close the ingate passages. Thereafter, the molds and the ingate structure are separated as a unit from the fill tube and then the molds are subsequently separated from the ingate structure. The patent indicates that the viscosity and surface tension of molten metal, if any, in the restricted (partially closed) ingate passages prevents run-out of molten metal therefrom, even though the metal above and below the ingate passages may still be in the molten state.

It is an object of the invention to provide a method and apparatus for the differential pressure, countergravity casting of a melt in substantially shortened cycle times into a casting mold having unique inlet passage-forming means between a lower mold portion engageable with an underlying melt source and a mold cavity, wherein the inlet passage-forming means reduces run-out of the melt from the mold when the mold and the melt source are disengaged prior to solidification of the melt in the mold.

It is an object of the invention to provide a method and apparatus for the differential pressure, countergravity casting of a melt in substantially shortened cycle times into a casting mold wherein the inlet passage-forming means reduces runout of the melt from the mold when the mold is tilted to an inverted position after disengagement from the source and prior to solidification of the melt in the mold.

SUMMARY OF THE INVENTION

The present invention provides a method and apparatus for the differential pressure, countergravity casting of a melt wherein a mold is provided having a mold cavity, a lower mold portion adapted for engaging an underlying source of melt, and a melt inlet passage-forming means disposed between the mold cavity and the lower mold portion. The melt inlet passage-forming means includes a perforated portion defining at least one melt inlet passage for communicating the lower mold portion and the mold cavity and an adjacent melt impermeable portion.

The mold and the melt source are relatively moved by suitable means to engage the lower mold portion and the source at a casting position. A differential pressure is applied by vacuum pump or other differential pressure means between the mold cavity and the source to urge the melt upwardly through the inlet passage into the mold cavity to fill it with the melt.

The melt-filled mold and the source are relatively moved to disengage the lower mold portion and the source after the mold cavity is filled with the melt.

The disengaged melt-filled mold is tilted by suitable means in a direction to raise the perforated portion of the inlet passage-forming means above the melt impermeable portion thereof so that the latter acts as a dam between the mold cavity and the lower mold portion to reduce run-out of the melt from the mold as the mold is tilted. Typically, the mold is tilted to an inverted position where the melt can solidify in the inverted mold.

In one embodiment of the invention, any gas (e.g., air) that may enter the mold via the melt inlet passage during the mold tilting operation is trapped to prevent the gas from entering the mold cavity. To this end, the inlet passage-forming means includes a second fluid impermeable portion spaced above the perforated portion as the mold is tilted such that the second fluid impermeable portion forms a gas entrapment chamber for trapping and isolating the gas as the mold is tilted.

In another embodiment of the invention, the inlet passage-forming means comprises a collar captured in the casting mold so as to constitute a mold component. The collar includes a first wall including the perforated portion and the adjacent melt impermeable portion, and a second wall spaced from the first wall and including the second fluid impermeable portion (gas entrapment portion) and a second perforated portion defining a melt outlet passage communicated to the melt inlet passage in the first wall via a chamber between the walls.

The present invention is especially useful, although not limited to the differential pressure, countergravity casting of high shrinkage metals and alloys, such as steels, stainless steels and superalloys, which were prone heretofore to run-out from the mold during the mold tilting operation.

DETAILED DESCRIPTION OF THE INVENTION

Figure 1:
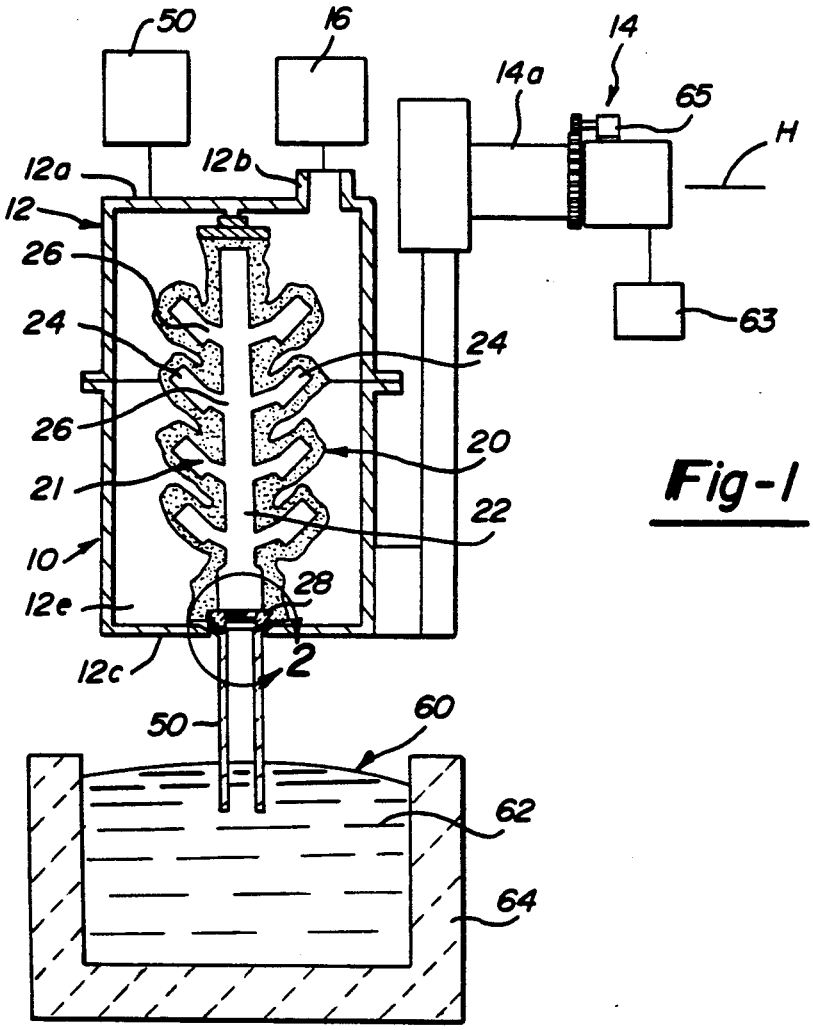
FIG. 1 is a schematic sectioned elevational view of a casting apparatus according to one embodiment of the invention.
Figure 2:
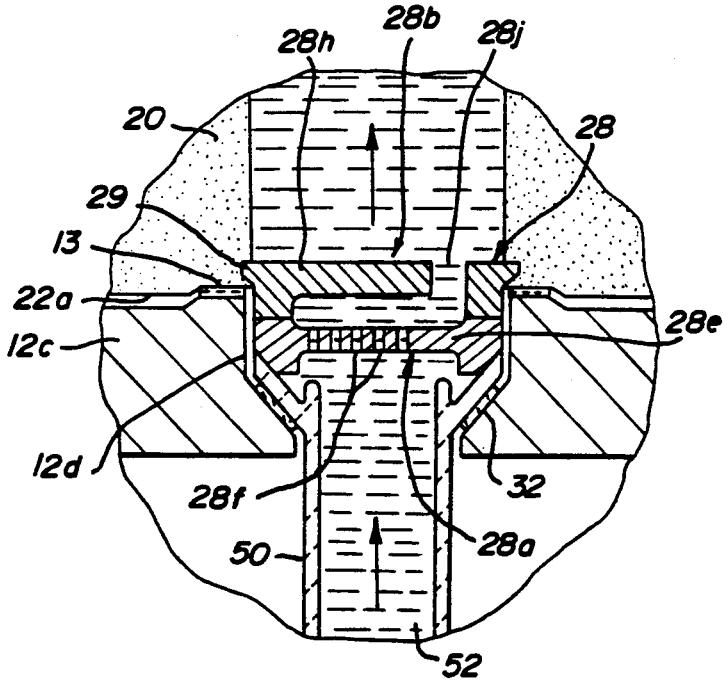
FIG. 2 is an enlarged view of the encircled portion of FIG. 1 after countergravity filling of the mold with molten metal from the underlying molten metal pool.

Referring to the drawings, there is provided a casting apparatus 10 including a partitioned, sealable casting chamber 12 mounted on a vertically movable and horizontally rotatable support arm 14. The casting chamber 12 includes an upper wall **12*a* having a conduit 12*b* communicated to a differential pressure apparatus 16, e.g., a vacuum pump, and a lower, mold supporting wall 12*c* for supporting via a gasket 13 a porous, gas permeable mold 20, which is shown as a ceramic investment shell mold, although the invention is not so limited. The gas permeable mold 20 includes a main mold cavity 21 having a longitudinal, vertical riser passage 22 communicating with a plurality of article-shaped mold cavities 24 thereabove via respective lateral ingate passages 26. The article-shaped mold cavities 24** are configured in the shape of the articles to be cast.

The gas permeable mold 20 includes an annular, ceramic mold collar or component 28 constituting inlet passage-forming means captured in the open lower end of the mold. The ceramic mold collar 28 extends below the mold bottom **22*a* through a central opening 12*d* in lower, mold-supporting wall 12*c* of the casting chamber 12. The collar 28 is positioned between the mold cavity 21 and a typically expendable, elongated, ceramic lower mold fill pipe 50** (lower mold portion) which may be fastened to the collar by suitable adhesive material.

Referring to FIGS. 2 and 6–8, the inlet passage-forming collar 28 comprises a lower lateral (e.g., horizontal) wall **28*a* and an upper lateral (e.g., horizontal) wall 28*b* when the mold 20 is oriented in an upstanding position to orient the fill pipe 50 to face the underlying molten metal pool 60. The lower wall 28*a* includes a perforated portion 28*d* and a laterally extending melt impermeable (non-perforated) portion 28*e*. The perforated portion 28*d* defines a plurality of upstanding, side-by-side inlet passages 28*f* of cylindrical or other shape that communicate a lowermost fill passage 52 (FIG. 2) with the main mold cavity 21. As will be explained below, the melt impermeable portion 28*e*** provides an upstanding dam to reduce run-out of melt from the mold upon tilting of the mold following casting.

The upper wall **28*b* includes a outlet passage-forming portion 28*g* (perforated) overlying the melt impermeable portion 28*e* of the lower wall 28*a* and a fluid impermeable (non-perforated) portion 28*h* overlying the perforated portion 28*d* of the lower wall 28*a*. The outlet passage-forming portion 28*g* includes a single upstanding, arcuate melt outlet passage 28*j* that cooperates with the inlet passages 28*f* for communicating the lowermost fill passage 52 and the mold cavity 21. As will be explained below, the fluid impermeable portion 28*h* forms a gas (air) entrapment or isolation chamber 28*c* above the inlet passages 28*f* during mold tilting. The melt inlet and outlet passages 28*f*, 28*j* are in melt flow communication via the chamber 28*c***.

The collar 28 may be formed as two pieces which are jointed (fired) together at a parting plane P therebetween. The collar 28 is typically formed of a substantially gas impermeable material, such as mullite, for use in countergravity casting such alloys as steels, stainless steels and Ni, Co or Fe superalloys. The collar 28 includes an annular rim 29 that is captured in the mold 20 as shown best in FIG. 2.

The inlet passage-forming collar 28 functions primarily as a molten metal (melt) holding means for retaining molten metal in the mold 20 as a will be explained below and only secondarily as a strainer or filter to prevent oxide, slag and other debris particles in the molten metal from entering the mold 20. To this end, the inlet passages 28*f* have size and lateral spacing from one another that are selected primarily to establish a molten metal present in the inlet passages 28*f* during draining of the molten metal from the mold fill pipe 50 as will be explained herebelow. As is apparent, the inlet passages 28*f* have a substantially constricted (reduced) cross-sectional (e.g., diameter) as compared to that of the fill passage 52 to this end.

The elongate ceramic mold fill pipe 50 defines a longitudinal fill passage 52 therein and is sealingly received in the chamber wall 12*c* via a refractory gasket 32. As shown best in FIG. 1, the elongate ceramic fill pipe 50 depends from the bottom side of the mold 20 toward an underlying molten metal pool 60 (melt source) formed by molten metal (melt) 62 held in a crucible or container 64. The cross-section (e.g., diameter) of the fill pipe 50 is relatively large compared to the cross-section (e.g., diameter) of the inlet passages 28*f* of the collar 28.

The casting chamber 12 with the mold 20 supported therein is lowered on the support arm 14 toward the molten metal pool 60 to a casting position where the open lower end of the ceramic fill pipe 50 is immersed in the molten metal (melt) 62, FIG. 1. The support arm 14 is lowered by a suitable actuator 63 such as a hydraulic pneumatic, electrical or other actuator. After the fill pipe 50 is immersed in the molten metal, a vacuum is drawn in the casting chamber 12 by differential pressure apparatus 16 (vacuum pump) through the conduit 12*b*. Drawing of the vacuum in the casting chamber 12*e* evacuates the mold cavities 24 through the porous, gas permeable mold 20 and applies a differential pressure to the mold 20 relative to the molten metal pool 13 to cause the molten metal 62 to flow upwardly through the fill pipe 50, passages 28*f* and 28*j*, the riser passage 22, and the lateral ingate passages 26 to fill the mold cavities 24 with the molten metal. During filling of the mold cavities 24 in this manner, the molten metal entering the mold is filtered by the inlet passages 28*f* in the ceramic collar 28 to remove objectionable particles therefrom too large to pass through the passages 28*f*. However, this filtering action is only a secondary consequence of practicing the invention, the primary consequence and objective being molten metal retention in the casting mold 20 after mold filling and during draining of molten metal 62 from the fill passage 52 prior to inversion of the mold 20, as will be explained below.

Figure 3:
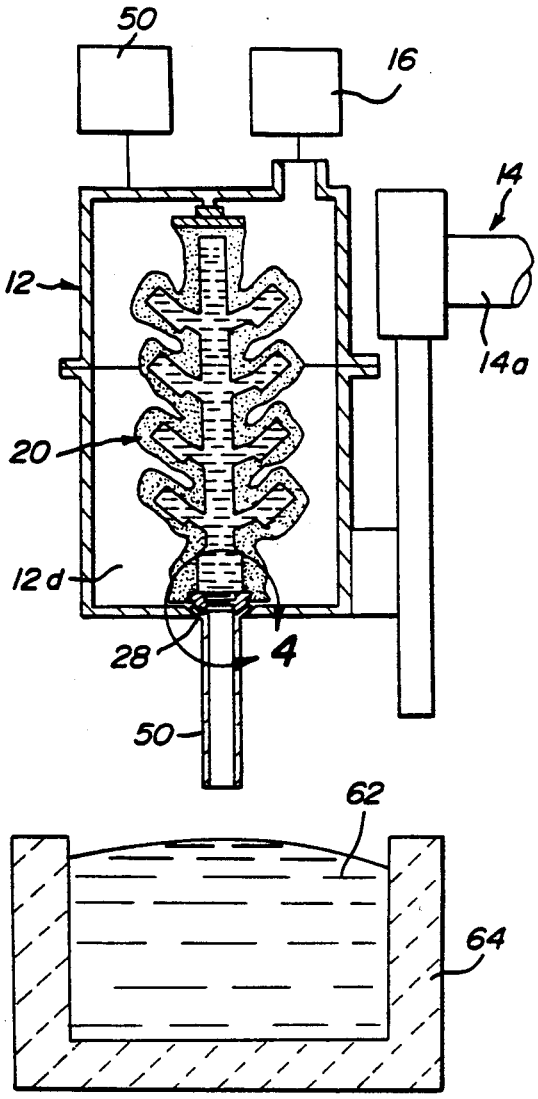
FIG. 3 is similar to FIG. 1 with the mold fill pipe withdrawn from the molten metal pool for draining of molten metal therefrom.

After the mold cavities 24 are filled, the support arm is raised by the actuator 63 to raise the casting chamber 12 and molten metal-filled mold 20 supported thereon a sufficient distance away from the molten metal pool 60 to withdraw (disengage) the open lower end of the fill pipe 50 from the molten metal 12, FIG. 3. During raising of the casting chamber 12 and the mold 20 supported therein, the vacuum is maintained in the casting chamber 12 by the differential pressure apparatus 16.

Figure 4:
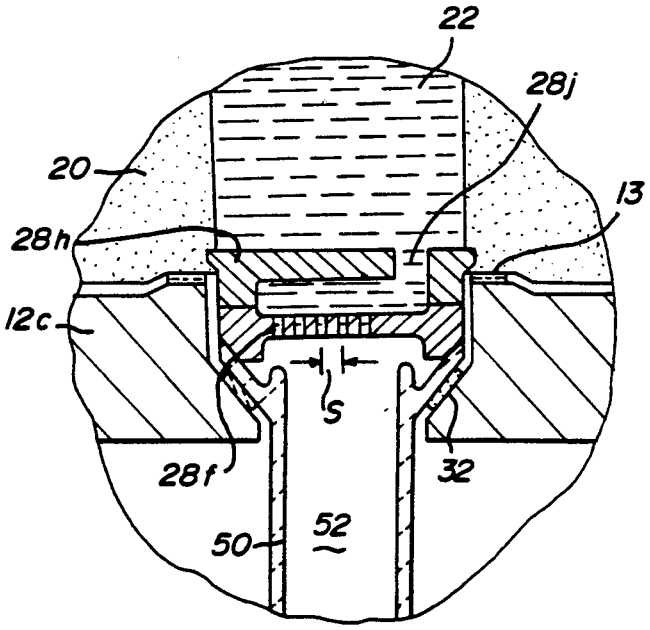
FIG. 4 is an enlarged view of the encircled portion of FIG. 3 after the fill tube is drained of molten metal.

Upon withdrawal of the fill pipe 50 from the molten metal pool 60, the molten metal in the fill pipe 50 begins to drain out by gravity-induced run-out due to the relatively large diameter of the fill passage 52, FIGS. 3 and 4. However, the molten metal in the constricted, longitudinal inlet passages 28*f* in the ceramic collar 28 and the molten metal above the ceramic collar 28 (i.e., in the main mold cavity 21) is held against gravity-induced run-out at least until the fill pipe 50 is drained of molten metal and the mold 20 is inverted, by a combination of the differential pressure applied to the mold 20 (and thus to the molten metal in the inlet passages 28*f* and the main mold cavity 21) and by a molten metal surface tension holding action established in the constricted longitudinal inlet passages 28*f* of the collar 28. In particular, the selection of the number, size, spacing and shape of the inlet passages 28*f* is based on the need (1) to fill the mold cavities 24 in a relatively short time to prevent metal solidification before the mold cavities 24 are filled and the mold 20 is inverted and (2) to hold, for a given applied differential pressure, the molten metal in the inlet passages 28*f* and in the mold cavity 21 thereabove when the fill tube 50 is removed from the molten metal pool 60, at least until the fill tube can be drained of molten metal and the mold 20 can be inverted. The number, cross-sectional size (e.g., diameter), and vertical length of the inlet passages 28*f* which will prove useful depends in part on the surface tension of the molten metal being cast as well as the surface tension between the molten metal and the particular ceramic material from which the collar 28 is made. Higher surface tension values for the molten metal and between the molten metal and the ceramic collar 28 enable use of a larger number of larger sized (larger diameter) inlet passages 28*f*.

Furthermore, the lateral spacing S between adjacent inlet passages 28*f* is controlled to prevent "creeping" of the molten metal 12 from one inlet passage 28*f* to another on the bottom side of the downstream wall 28*a* and eventual joining of the molten metal 12 in the various inlet passages 28*f*. Once the molten metal 12 in the various inlet passages 28*f* joins on the bottom side of the wall 28*a*, the molten metal 12 may run-out from the inlet passages 28*f* before the fill tube 50 is drained and the mold 20 is inverted. The amount of lateral spacing S required between the inlet passages 28*f* to prevent such "creeping" and joining of the molten metal 12 will depend on the surface tension of the molten metal relative to the ceramic of the collar 28.

Figure 5:
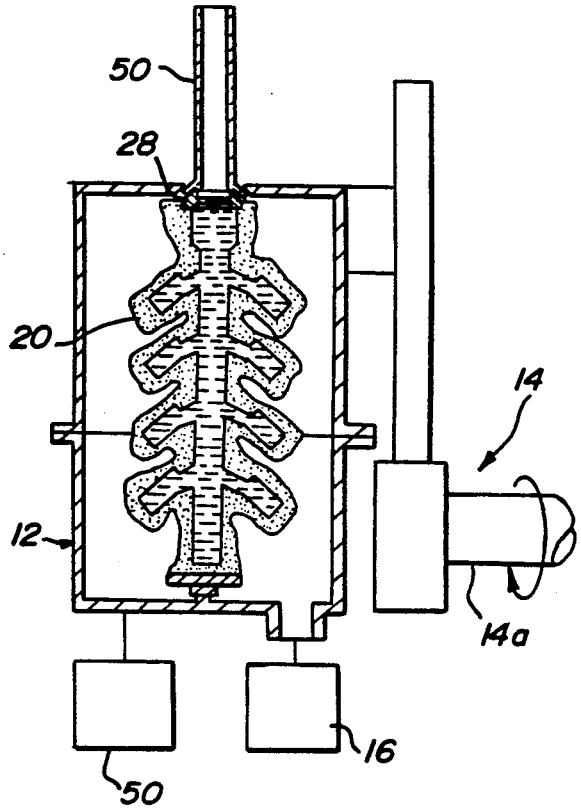
FIG. 5 is a schematic sectioned elevational view of the casting apparatus after the mold is inverted to effect solidification of the molten metal in the inverted mold.
Figure 6:
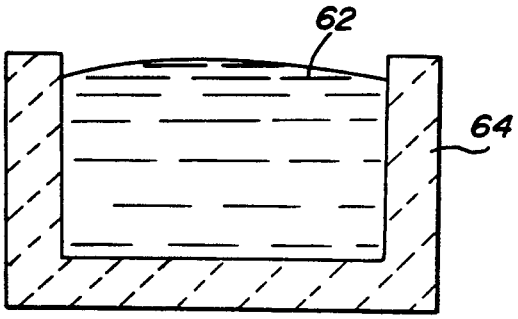
FIG. 6 is a cross-sectional view of the ceramic inlet passage-forming collar.
Figure 6:
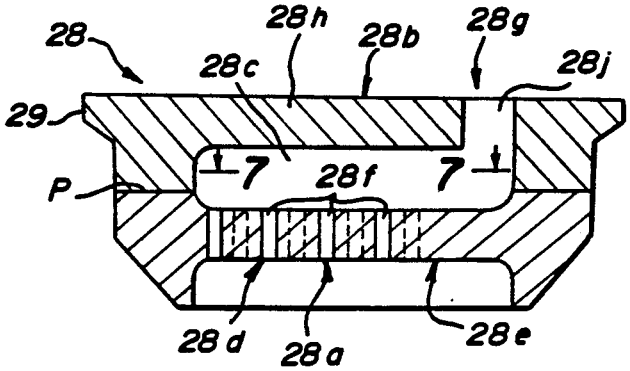
Figure 7:
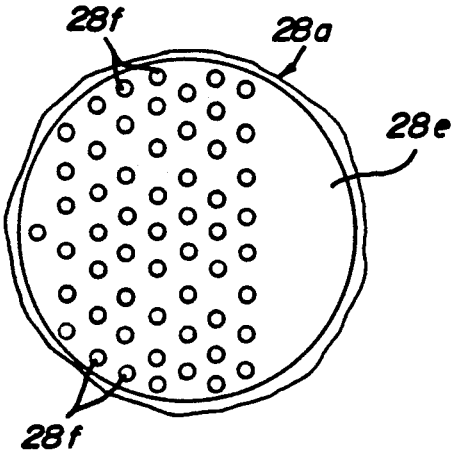
FIG. 7 is a fragmentary plan view of the lower wall of the ceramic inlet passage-forming collar along lines 7—7 of FIG. 6.
Figure 8:
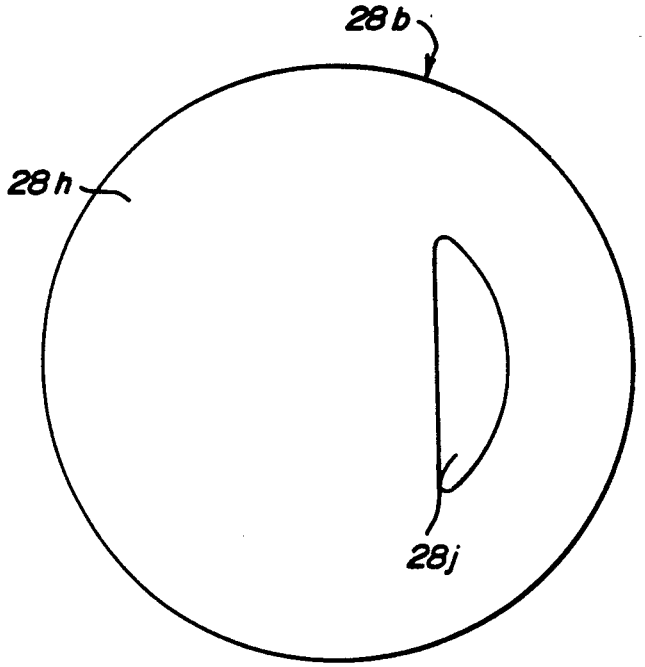
FIG. 8 is a plan view of the upper wall of the ceramic inlet passage-forming collar.

Typically, the molten metal will be held in the inlet passages 28*f* for at least several seconds for high shrinkage alloys, such as steels, stainless steels, Ni, Co or Fe superalloys and the like, after the fill pipe 50 is withdrawn from the molten metal pool 60. This delay period for run-out of molten metal from the inlet passages 28*f* provides an opportunity to tilt the casting chamber 12 and the mold 20 to orient them in an inverted position where the mold bottom faces upwardly, FIG. 5, while the molten metal in the inlet passages 28*f*, riser passage 22, lateral ingates 26 and mold cavities 24 remains in the liquid state. A rotary actuator 65 of the conventional type is provided to rotate an extension 14*a* of the support arm 14 about a horizontal axis H to invert the casting chamber 12 and the molten metal-filled mold 20 therein.

The molten metal in the inlet passages 28*f* and the mold cavities 24 remains in a substantially unsolidified, liquid state while the fill passage 52 is drained and before the metal-filled mold 20 is tilted to the inverted position.

The inlet passage-forming collar 28 functions to reduce molten metal leakage from the inlet passages 28*f* to harmless levels during tilting of the disengaged, melt-filled mold 20 to the inverted position. For example, referring to FIGS. 9A, 9B and 9C, the collar 28 is shown after a small degree of tilting (FIG. 9A), at the mid-point of the tilting operation (FIG. 9B-mold in the horizontal position) and at the end of the tilting operation (FIG. 9C-mold fully inverted).

Figure 9A:
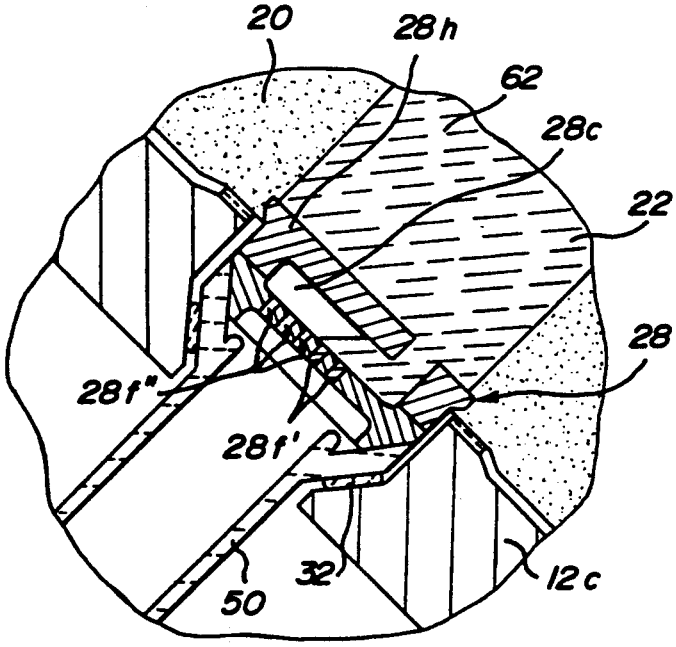
FIGS. 9A, 9B and 9C illustrate the mold (only partially shown) and inlet passage-forming collar at various positions during tilting of the mold.
Figure 9B:
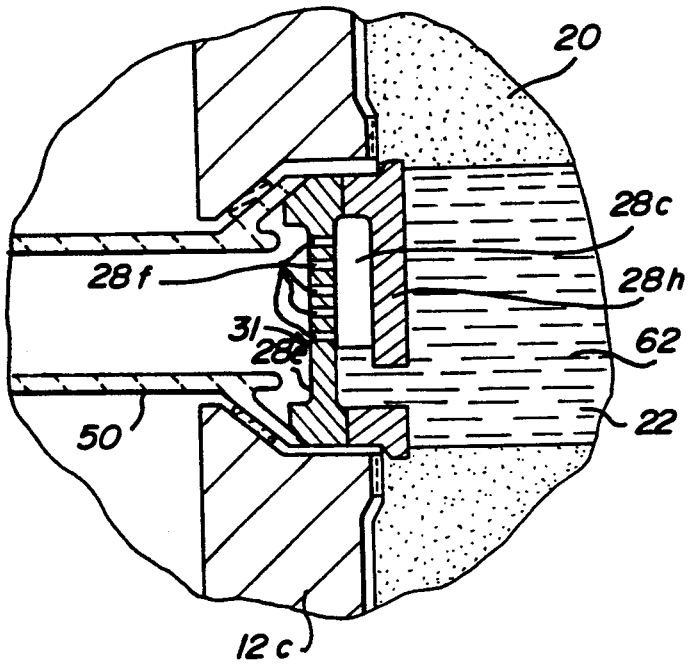
Figure 9C:
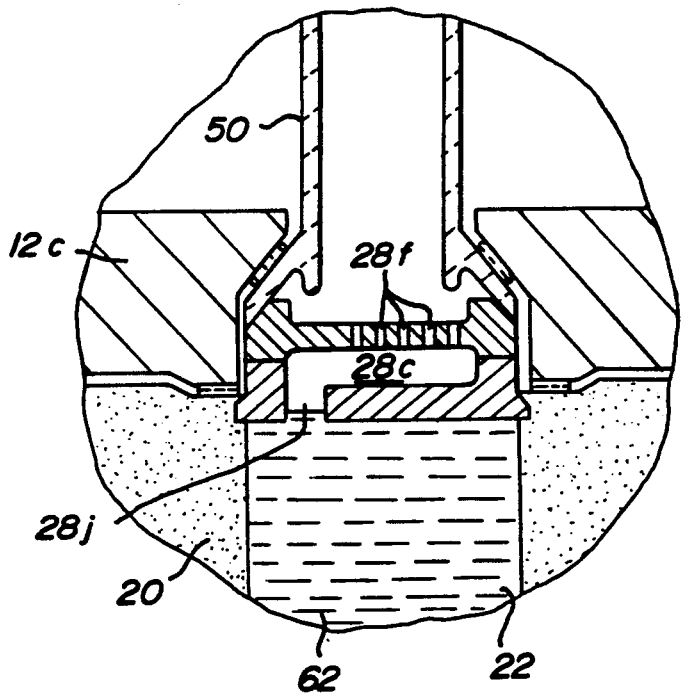

Referring to FIG. 9A, as the disengaged mold 20 is initially tilted from the upstanding position toward the inverted position, the holding power of the vacuum in the container 12 on the molten metal in the mold 20 gradually decreases as a result of the reorientation of the mold. At the same time, the metallostatic head effect arising from the molten metal in the air entrapment chamber 28*c* wants to cause the molten metal therein to flow downwardly and out the lower inlet passages 28*f* of FIG. 9A. The upper inlet passages 28*f*'' of FIG. 9A are thereby exposed to entry of air therethrough which, if allowed to enter the riser passage 22 and mold cavities 24, could cause displacement of an equal volume of molten metal from the mold. However, as is apparent in FIG. 9A, any air entering the inlet passages 28*f*'' during the mold tilting operation will be isolated and confined below the riser passage 22 and mold cavities 24 in the air entrapment chamber 28*c* formed by the fluid impermeable portion 28*h* of the wall 28*b* overlying the inlet passages 28*f*''.

Moreover, as the tilting operation progresses, the melt impermeable portion 28*e* of the wall 28*a* acts as an upstanding dam 31 (FIG. 9B) for confining the molten metal in the chamber 28*c* to reduce metal leakage during mold tilting. As a result, only a minor, harmless amount of the molten metal in the chamber 28*c* may run out of the mold via the inlet passages 28*f* during the molding tilting operation. Once the mold is inverted, FIG. 9C, there is no problem of metal leakage as will be apparent. Molten metal in the inlet passages 28*f* flows therefrom toward the mold cavity 21, leaving passages 28*f* empty.

After the mold 20 is inverted, the differential pressure applied thereto is released (by vacuum release means 50, such as a suitable valve providing ambient pressure in the casting chamber 12) to allow the molten metal in riser passage 22, ingate passages 26 and the mold cavities 24 to solidify in the inverted mold under ambient pressure.

Following release of the differential pressure on the inverted, molten metal-filled mold 20, the casting chamber 12 is free for removal from the mold 20 and can be used in casting the next successive mold 20. As a result, the casting cycle time is reduced and the production throughput of the casting process is increased.

The invention is especially useful in countergravity casting high shrinkage metals and alloys (e.g., steels, stainless steels, and Ni, Co and Fe based alloys and superalloys). The term high shrinkage refers to the volumetric contraction of the molten metal when it is cooled from the casting temperature to ambient temperature during the solidification step of the process. Certain steels exhibit a high volumetric shrinkage such as about 10% upon cooling from the casting temperature to ambient temperature whereas, in contrast, grey and nodular cast irons exhibit relatively low volumetric shrinkage such as less than about 1%. Applicants have discovered that high shrinkage metals and alloys can be countergravity cast in accordance with this invention without harmful runout of the melt from the mold during the mold tilting operation. Low shrinkage metals and alloys can also be countergravity cast in this manner. However, the invention is especially useful in casting high shrinkage metals and alloys which are more prone to runout of the mold during the mold tilting operation.

The following Example is offered to illustrate, but not limit, the invention.

EXAMPLE

About 70 pounds of a type 8620 steel melt were cast into a ceramic shell mold mounted on apparatus like that illustrated hereinabove. The mold included a mullite ceramic collar 28 like that described hereinabove. The lower wall 28*a* (diameter=2 inches) of the collar included 58 holes of 0.090 inch diameter and 0.38 inch vertical length spaced apart by a spacing (S) of about 0.060 inch. The upper wall 28*b* of the collar 28 included an outlet 28*j* having an arcuate length of 1.5 inches, a maximum width of 0.3 inch, and vertical length of 0.38 inch. A reduced pressure of 9 psia was used to cast the 70 pounds of 8620 steel melt into the mold. The collar 28 was effective in limiting runout of the melt from the inlet passages 28*f* to a small, harmless amount that did not adversely affect the soundness of the castings formed in the mold upon solidification of the melt at the mold inverted position.

In lieu of the mold 20 described above, the present invention may also be practiced with countergravity casting processes and apparatus that use destructible patterns suspended in a mass of particulate mold material to define mold cavities in the particulate mass (e.g., see U.S. Pat. No. 4,874,029) or mold member supported in a mass of particulate material (e.g., see U.S. Pat. No. 4,957,153).

While the invention has been described in terms of specific embodiments thereof, it is not intended to be limited thereto but rather only to the extent set forth hereafter in the following claims.

I claim:

1. In a method for the countergravity casting of a melt, comprising the steps of:

a) forming a mold having a mold cavity, a lower mold portion adapted for engaging an underlying source of melt and having a fill passage, and inlet passage-forming means disposed between the mold cavity and the lower mold portion, said inlet passage-forming means including a perforated portion defining at least one melt inlet passage for communicating the fill passage and the mold cavity and an adjacent melt impermeable portion extending laterally inwardly from a periphery of said inlet passage-forming means partially across said fill passage toward said perforated portion to form a dam when the mold is tilted after filling with said melt, said inlet passage-forming means further including a fluid impermeable portion spaced above said perforated portion when the lower mold portion and the source are engaged, b) relatively moving the mold and the source of the melt to engage the lower mold portion and the source, c) applying a differential pressure between the mold cavity and the source to urge the melt upwardly through the inlet passage into the mold cavity to fill the mold cavity with the melt, d) relatively moving the mold and the source to disengage the lower mold portion and the source after the mold cavity is filled with the melt, and e) tilting the disengaged mold in a direction to raise the perforated portion above the melt impermeable portion such that said melt impermeable portion acts as a dam extending partially across said fill passage to reduce run-out of the melt from the mold as the mold is tilted and such that said fluid impermeable portion entraps any gas that may enter the mold through said perforated portion so as to prevent the gas from entering the mold cavity.

2. The method of claim 1 including continuing tilting of the mold until it is inverted.

3. The method of claim 2 including solidifying melt in the inverted mold.

4. The method of claim 1 wherein the melt comprises a high shrinkage melt such as a steel, stainless steel or superalloy melt.

5. In a method for the countergravity casting of a melt, comprising the steps of:

a) forming a mold having a mold cavity, an upstanding fill passage on a bottom side thereof adapted for engaging an underlying source of melt, and inlet passage-forming means disposed between the mold cavity and the fill passage, said inlet passage-forming means including a perforated portion defining at least one melt inlet passage for communicating the fill passage and the mold cavity and an adjacent melt impermeable portion extending laterally inwardly from a periphery of said inlet passage-forming means partially across said fill passage toward said perforated portion to form a dam when the mold is tilted after filling with said melt, said inlet passage-forming means further including a fluid impermeable portion spaced above said perforated portion when the fill passage and the source are engaged, b) relatively moving the mold and the source of the melt to engage the lower mold portion and the source, c) applying a differential pressure between the mold cavity and the source to urge the melt upwardly through the fill passage and the inlet passage into the mold cavity to fill the mold cavity with the melt, d) relatively moving the mold and the source to disengage the fill passage and the source after the mold cavity is filled with the melt, including draining the melt from the fill passage, and then e) tilting the disengaged mold in a direction to raise the perforated portion above the melt impermeable portion such that said melt impermeable portion acts as a dam extending partially across the fill passage to reduce run-out of the melt from the mold during tilting of the mold and such that said fluid impermeable portion entraps any gas that may enter the mold through said perforated portion so as to prevent the gas from entering the mold cavity.

6. The method of claim 5 including continuing tilting of the mold until it is inverted.

7. The method of claim 6 including solidifying melt in the inverted mold.

8. The method of claim 5 wherein the melt comprises a high shrinkage melt such as a steel, stainless steel or superalloy melt.

9. Countergravity casting apparatus, comprising:

a) a mold having a mold cavity, a lower mold portion adapted to engage an underlying source of melt and having a fill passage, and inlet passage-forming means disposed between the mold cavity and the lower mold portion, said inlet passage-forming means including a perforated portion defining at least one inlet passage for communicating the fill passage and the mold cavity and an adjacent melt impermeable portion extending laterally inwardly from a periphery of said inlet passage-forming means partially across said fill passage toward said perforated portion to form a dam when the mold is tilted after filling with said melt for reducing run-out of the melt from the mold, said inlet passage-forming means further including a fluid impermeable portion spaced above said perforated portion when the lower mold portion and the source are engaged, b) means for relatively moving the mold and source to engage said lower mold portion and the source, c) means for applying a differential pressure between the mold cavity and the source sufficient to urge the melt upwardly through said inlet passage into the mold cavity when said lower mold portion is engaged with said source d) means for relatively moving the mold and the source to disengage said lower mold portion and the source after the mold cavity is filled with the melt, and e) means for tilting the disengaged mold in a direction to raise the perforated portion above the melt impermeable portion such that said melt impermeable portion acts as a dam extending partially across the fill passage to reduce run-out of the melt from the mold during mold tilting and such that said fluid impermeable portion entraps any gas that may enter the mold through said perforated portion so as to prevent the gas from entering the mold cavity.

10. The apparatus of claim 9 wherein said inlet passage-forming means includes a second perforated portion opposing said melt impermeable portion, said second perforated portion defining a melt outlet passage communicating the said melt inlet passage to the mold cavity.

11. The apparatus of claim 10 wherein said inlet passage-forming means comprises a first wall including said perforated portion and said melt impermeable portion and a second wall spaced substantially parallel to said first wall, said second wall including said second perforated portion and said fluid impermeable portion.

12. The apparatus of claim 9 wherein said lower mold portion comprises a fill pipe attached to a bottom of the mold and said inlet passage-forming means is disposed between the fill tube and the mold cavity.

13. The apparatus of claim 10 wherein said passage-forming means comprises a refractory collar captured in the bottom of the mold.

* * * * *

UNITED STATES PATENT AND TRADEMARK OFFICE

CERTIFICATE OF CORRECTION

PATENT NO. : 5 146 973

DATED : September 15, 1992

INVENTOR(S) : George D. CHANDLEY

It is certified that error appears in the above-identified patent and that said Letters Patent is hereby corrected as shown below:

Column 7, line 11; replace "28f" with ---28f'---.
line 12; replace "28f'" with ---28f''---.
line 17; replace "28f'" with ---28f''---.
line 22; replace "28f'" with ---28f''---.

Signed and Sealed this

Twenty-first Day of September, 1993

*Attest:*

*Attesting Officer*

BRUCE LEHMAN

*Commissioner of Patents and Trademarks*